US008464407B2

(12) United States Patent
Von Der Ahe et al.

(10) Patent No.: US 8,464,407 B2
(45) Date of Patent: Jun. 18, 2013

(54) QUICK RELEASE BUCKLE WITH DUAL RELEASE

(75) Inventors: Kenneth L. Von Der Ahe, Gilbert, AZ (US); Kenneth W. Sego, Jr., Phoenix, AZ (US); Michael James McElroy, Gilbert, AZ (US)

(73) Assignee: BAE Systems Aerospace & Defense Group Inc., Phoenix, AZ (US)

( * ) Notice: Subject to any disclaimer, the term of this patent is extended or adjusted under 35 U.S.C. 154(b) by 212 days.

(21) Appl. No.: 12/976,285

(22) Filed: Dec. 22, 2010

(65) Prior Publication Data

US 2011/0162177 A1 Jul. 7, 2011

Related U.S. Application Data

(60) Provisional application No. 61/289,770, filed on Dec. 23, 2009.

(51) Int. Cl.
*A44B 11/26* (2006.01)

(52) U.S. Cl.
USPC ..... 24/634; 24/648

(58) Field of Classification Search
USPC ..... 24/648, 634, 635, 650, 657
See application file for complete search history.

(56) References Cited

U.S. PATENT DOCUMENTS

| | | | | |
|---|---|---|---|---|
| 3,713,192 | A | 1/1973 | Wallin | |
| 5,806,148 | A | 9/1998 | McFalls et al. | |
| 6,154,935 | A | 12/2000 | Gregory et al. | |
| 6,487,761 | B2 * | 12/2002 | Van Tassel | 24/606 |
| 6,668,434 | B2 | 12/2003 | Casebolt et al. | |
| 7,155,786 | B2 | 1/2007 | Grimm | |
| 7,350,277 | B1 | 4/2008 | Canfield et al. | |
| 7,373,701 | B2 | 5/2008 | Coulombe et al. | |
| 7,448,116 | B1 | 11/2008 | Howell | |
| 2002/0092140 | A1 | 7/2002 | Van Tassel | |
| 2003/0074772 | A1 | 4/2003 | Chen | |
| 2003/0145435 | A1 | 8/2003 | Carver | |
| 2006/0080811 | A1 | 4/2006 | Grimm | |
| 2008/0066268 | A1 | 3/2008 | Hampton | |
| 2010/0313392 | A1 * | 12/2010 | Anscher | 24/616 |
| 2011/0030180 | A1 * | 2/2011 | Parisi et al. | 24/611 |

FOREIGN PATENT DOCUMENTS

| | | |
|---|---|---|
| DE | 196 47 631 | 5/1998 |
| FR | 2 926 009 | 7/2009 |
| WO | WO 2009134608 A2 * | 11/2009 |

OTHER PUBLICATIONS

PCT International Application No. PCT/US10/61822, International Search Report and Written Opinion dated Arp. 14, 2011.

* cited by examiner

*Primary Examiner* — James Brittain
(74) *Attorney, Agent, or Firm* — Kane Kessler, P.C.; Paul E. Szabo

(57) ABSTRACT

A buckle includes two pawls engageable by a tongue. A single spring controls the position of the pawls. The buckle has a manual primary release mode of operation. The buckle also has a secondary release mode of operation, in which the spring acts as a secondary release member for the pawls. This is actuated by pulling force exerted by a single point release lanyard of a quick release vest.

6 Claims, 3 Drawing Sheets

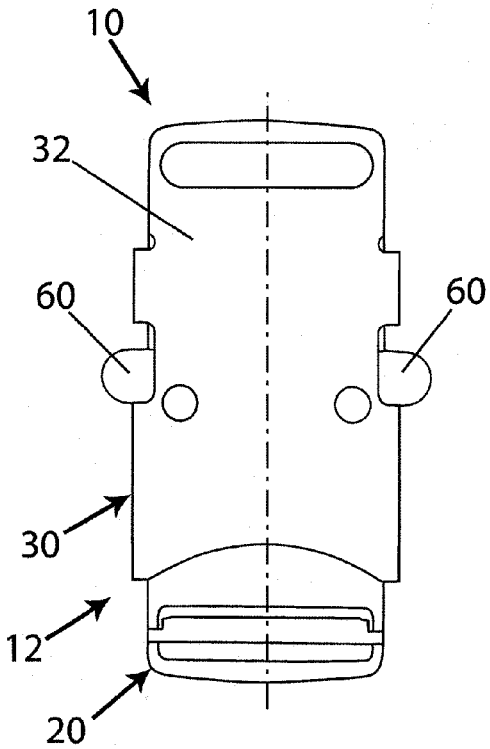
Figure 1
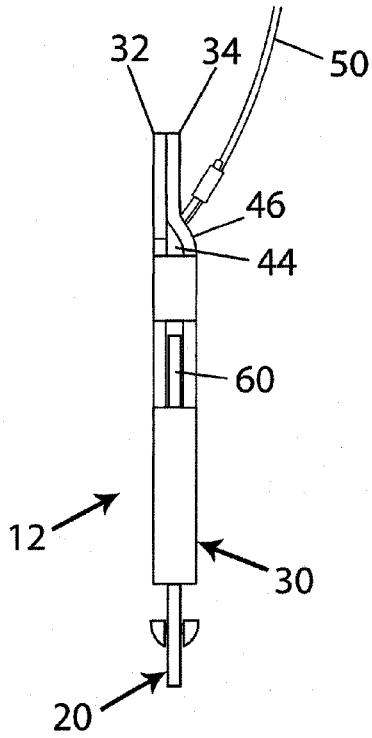
Figure 2
Figure 3
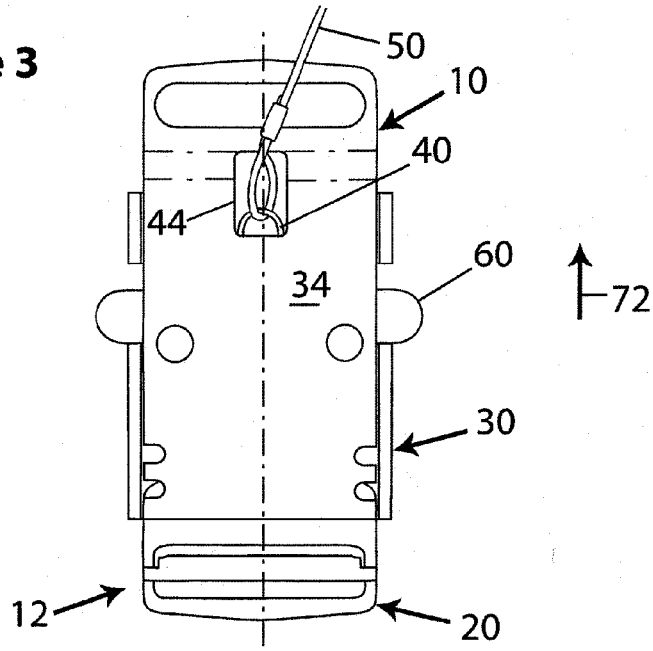

QUICK RELEASE BUCKLE WITH DUAL RELEASE

BACKGROUND OF THE INVENTION

The present invention relates to a quick-release buckle that can be released either as a typical side-release buckle, or as a remotely-released, cable/lanyard-actuated buckle. The buckle can be incorporated into a garment, for example, a soldier's quick-release vest. In such an application, it is necessary for the soldier to be able to release an armored vest quickly and with minimal effort, to avoid being dragged down by the vest in an emergency situation. These vests have a quick-release mechanism that is actuated by single pull on a cable or lanyard to release the mechanism(s) holding together the vest parts. It is desirable to provide a quick-release vest which can be quickly and easily put together by an inexperienced soldier, then just as quickly and easily released. The present invention provides a dual release buckle that can be both easily engaged and easily disengaged.

BRIEF DESCRIPTION OF THE DRAWINGS

FIG. 1 is a schematic top plan view of a buckle that is a first embodiment of the invention;

FIG. 2 is a side elevational view of the buckle of FIG. 1;

FIG. 3 is a bottom plan view of the buckle of FIG. 1;

DETAILED DESCRIPTION

Figure 4:
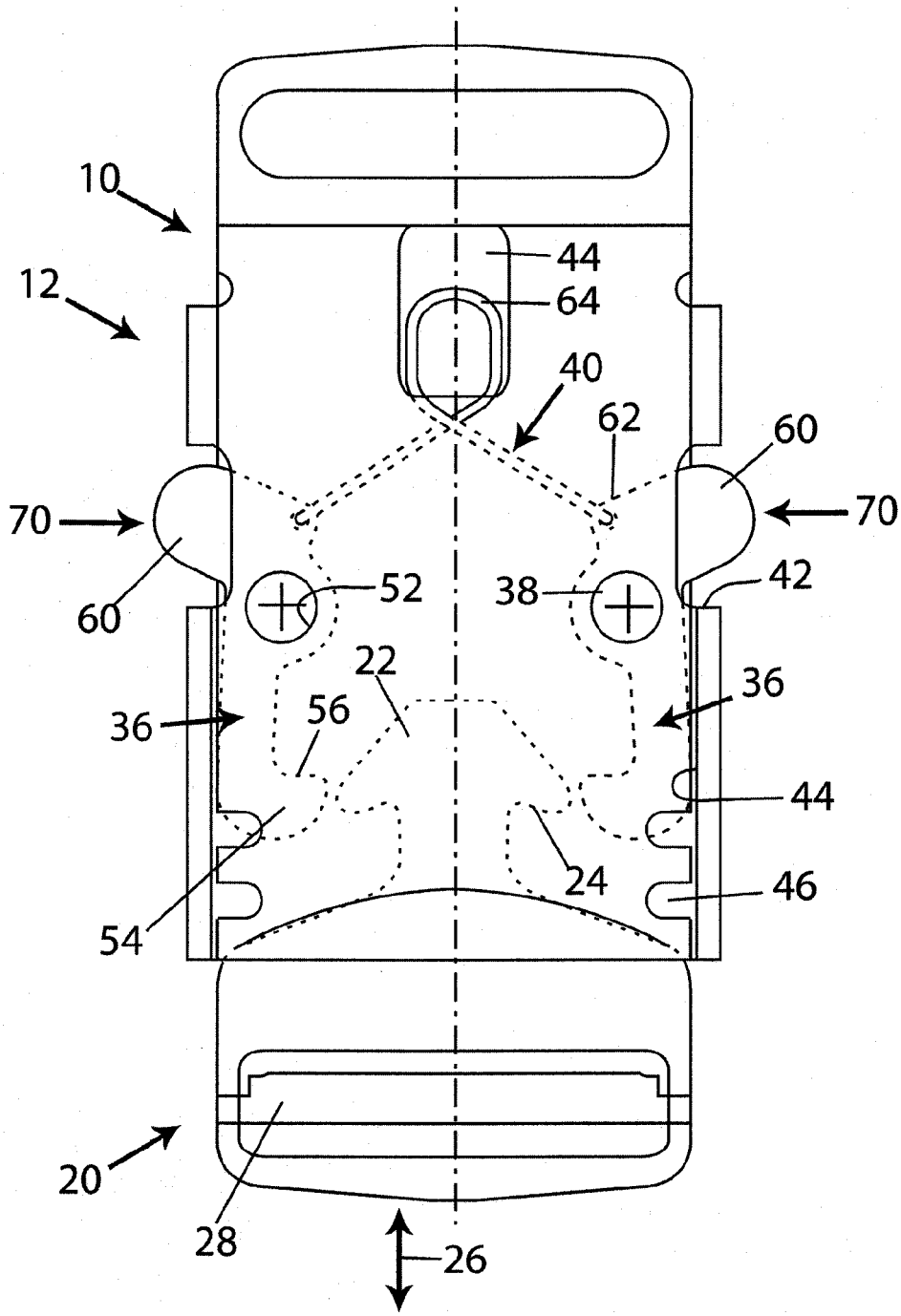
FIG. 4 is an enlarged internal view showing parts of the buckle of FIG. 1 in a released position.

The buckle 10 (female lock element) forms a part of a buckle assembly 12 that also includes a tongue 20 (male lock element). The tongue 20 (FIG. 4) has an arrow-shaped end portion 22 that is designed to engage with pawls in the buckle 10 as described below. The arrow-shaped end portion 22 of the tongue 20 includes two flat surfaces 24 that extend generally normal to the direction of movement 26 of the tongue into and out of the buckle 10.

The other end of the tongue 20 contains a slot 28 by which belt webbing or a strap (not shown) can be attached. In some embodiments, this end of the tongue 20 may also support a sliding element (not shown) that enables webbing to be passed around it and through the slot in a typical webbing adjuster fashion.

The buckle 10 includes a housing 30 (FIGS. 1-3) having an upper housing portion 32 and a lower housing portion 34. The buckle 10 (FIGS. 4 and 5) also includes two locking pawls 36, two pivot fasteners 38, and a spring 40. The upper and lower housing portions 32 and 34, when clamped together via the pivot fasteners 38, form a complete housing 30 and provide both pivot fastener locating features and motion stops for the pawls 36.

Motion stops are provided in both the engaged (42) and disengaged (44) pawl positions. The housing 30 may also incorporate one or more motion stop features 46 for the tongue 20 that limit its depth of insertion. The housing 30 also constrains the vertical motion (inline with the pawl pivot axes) of the components that are internal to the housing—the pawls 36, the spring 40, and the tongue 20.

The lower housing portion 34 incorporates a hole or window 44 in the area of the spring 40. The lower housing portion 34 is shaped such that it bends (as at 46 in FIG. 2) toward the upper housing portion 32, meeting it in the area of the spring 40. This bend allows sufficient space for a cable/lanyard (shown partially at 50), that is attached to the torsion spring 40 as described below, to pass through the window 44 in the lower housing portion 34 and exit under the buckle 10 without being trapped against an object on which the buckle may be resting.

The pawls 36 (FIGS. 4 and 5) have openings 52 that receive the pivot fasteners. The pivot fasteners 38 provide fixed axes of rotation for the pawls 36. The pivot fasteners 38 may be threaded type fasteners with or without bearing sleeves, or simply shoulder rivets on which the pawls 36 directly rotate, or may be made of any other suitable construction. The pawls 36 have hook-shaped end portions 54 with locking surfaces 56 that are designed to engage with the arrow-shaped end portion 22 of the tongue 20

The pawls 36 have side portions 60 (FIGS. 1, 3, 4 and 5) opposite the locking portions 56, that serve as side-release actuating surfaces. The side portions 60 project outward from the housing 30 and are manually engageable.

Figure 5:
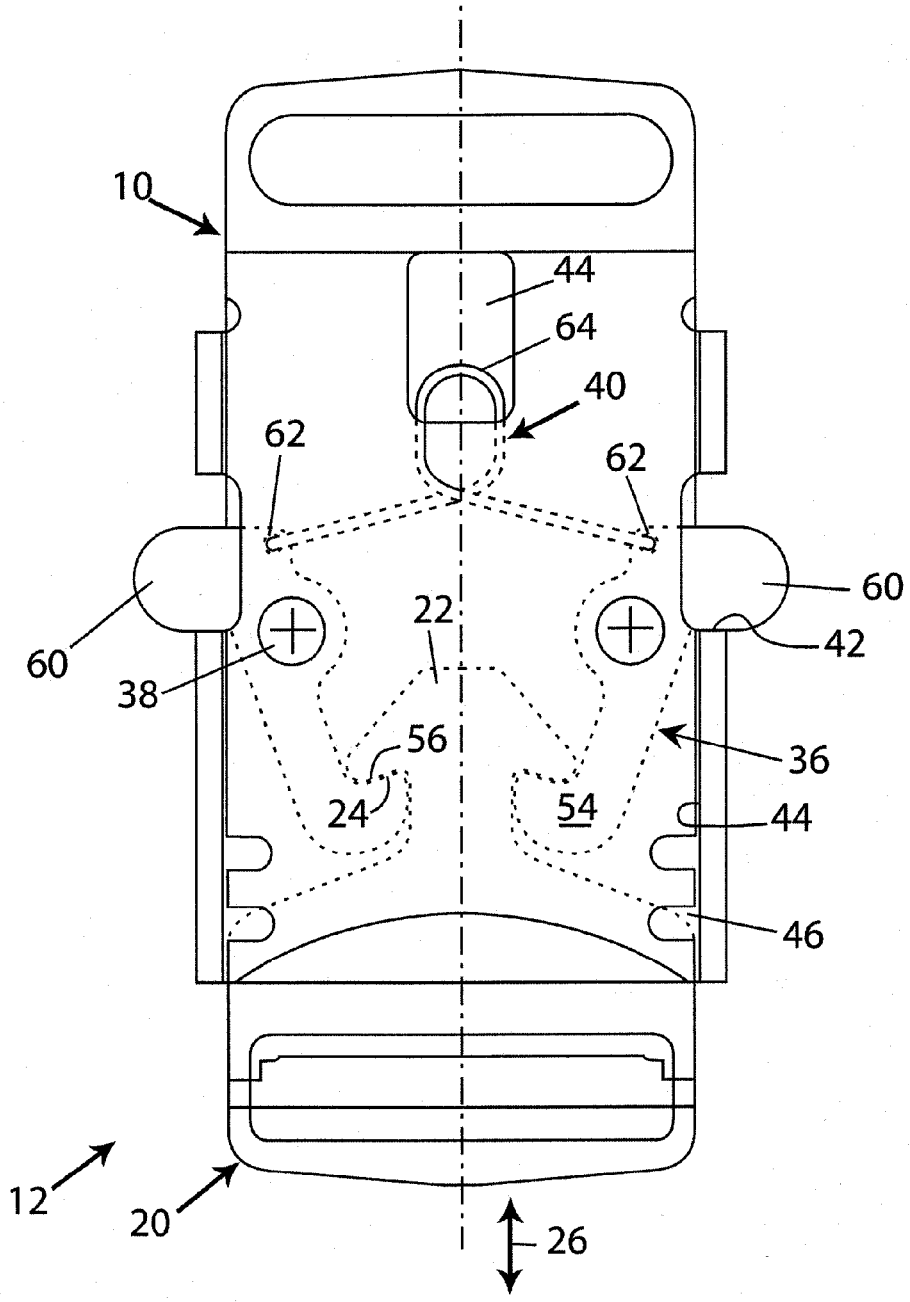
FIG. 5 is an enlarged internal view showing parts of the buckle of FIG. 1 in a locked position.

In the absence of external forces, the relative position of the pawls 36 is controlled by the spring 40 (FIGS. 4 and 5). The spring 40 is preferably a torsion coil spring as illustrated, although the spring may be of a different configuration. The free ends of the spring 40 are received in spring openings 62 in the pawls 36. The spring openings 62 are on the opposite side of the pawl pivot axes from the hook portions 54.

The centrally-located, coiled portion 64 of the torsion spring 40 is free-floating, that is, can move along the length of the buckle 10 (upward and downward as viewed in FIGS. 4 and 5, for example). The coil portion 64 of the spring 40 is located adjacent the window 44 in the lower housing portion 34. The spring 40 is constrained by the two housing portions 32 and 34 to move only in the plane of movement of the tongue 20 into and out of the buckle 10.

The spring 40 is wound in such a way that it is biased to force the pawls 36 toward or into a first or locking position as shown in FIG. 5. In this position, the space between the pawl end portions 54 is less than the width of the arrow-shaped end portion 22 of the tongue 20.

When the tongue 20 is inserted into the mouth of the buckle 10 (FIG. 4), the tongue end portion 22 forces apart the pawl end portions 54, moving the pawls 36 out of the first position and into a second or release position shown in FIG. 4, against the biasing force of the spring 40. Upon continued movement of the tongue 20 into the buckle 10, the tongue locking surfaces 24 pass behind the pawl locking surfaces 56. At that point of movement, the biasing force of the spring 40 urges the pawls 36 to move toward and into the locked or engaged position shown in FIG. 5. In this position, the shape and angle of the locking surfaces on the tongue 20 and on the pawls 36 are such that the buckle assembly 10 will not disengage under tension loading attempting to pull the tongue 20 out of the buckle 10. The buckle assembly 12 is locked, or engaged.

The primary release mode of operation for the buckle 10 is used when not in an emergency situation. Specifically, the pawls 36 can be disengaged from contact with the tongue 20 by applying opposing compressive forces (arrows 70 in FIG. 4) to the projecting side portions 60 of the pawls 36. This causes the pawls 36 to pivot to the release position as shown in FIG. 4. With the pawls 36 in this release position, the tongue 20 can be removed from the buckle 10.

The secondary release mode of operation for the buckle 10 is used when in an emergency situation. FIG. 5 illustrates this mode of operation and the associated mechanism.

Force is applied to the central portion or coil portion 64 of the spring 40 in the same direction in which the tongue 20 is inserted into the buckle 10 (upward as viewed in FIGS. 3 and 5, for example, as indicated by the arrow 72). This force may be applied by pulling on the single-point release lanyard 50 of the quick-release vest, for example. The pulling force is transmitted through the spring 40 into the pawls 36. The pawls 36 are pivoted into the released/unlocked position of FIG. 4. As a result, the pawls 36 no longer engage the tongue 20, and the tongue can be removed (released) from the buckle 10 as with the primary release mechanism.

The secondary pulling force is typically applied, as in the illustrated embodiment, to the central portion of the spring 40, although with a differently configured spring the force may be applied elsewhere on the spring, so long as it is applied in a manner that the force is transmitted via the spring to the pawls to move the pawls.

As noted, in a preferred embodiment, the force applied to the coil portion of the torsion spring 40 is applied via a cable or lanyard as at 50. If any portion of a force-applying member such as a cable or lanyard passes through the coiled section of the torsion spring 40, it should be of sufficiently small cross section to allow the torsion spring coils to flex or contract during operation.

Existing plastic quick-release buckles have load limitations due to material strength. Plastic quick-release buckles have a lower fatigue life due to the repeated deformation of the plastic required to actuate the lock. With the present invention, metallic components and pawl-type locking elements enable the buckle to react higher loads than all-plastic, deformable buckles. The metallic components also enhance durability over all-plastic, deformable buckles, with greater resistance to abuse, temperature, sand and dust, moisture, and solar radiation.

The buckle is preferably constructed from stamped sheet metal components and the two housing components are held together via the clamping of the pivot fasteners that serve as the pawl pivot axes. Preferably, stainless steel is used for holding strength, durability, and corrosion resistance, as well as to minimize buckle thickness. Other materials, including plastics, could be used for lower strength applications. The housing portions could be over-molded with rubber or some other compliant/resilient material. The use of stronger metallic components and pawl-type locking elements also enables the buckle to be thinner than plastic buckles.

The spring acts as a passive force element in its neutral position, keeping the pawls in a ready-to-engage/locked position. The spring also serves as a release member, in the secondary release mode of operation. The design of the spring thus enables the buckle to be released both by a primary release mechanism using certain components, and also by a secondary means (cable or lanyard) with no added components. Other side-release buckles with pawl-type locking elements typically use two springs. The present invention incorporates more function with one fewer spring than the prior art pawl-type buckles.

The lanyard or cable used to pull on the spring can exit either the top or bottom of the buckle, enabling it to enter or pass through an object that the buckle is in contact with (such as a garment). In a preferred embodiment, the cable/lanyard exits the bottom of the buckle, allowing it to enter or pass through a garment it is in contact with without being visible to the outside.

The pull axis of the buckle 10, in the secondary release mode of operation, is parallel to the overall plane of the buckle. Most prior art buckles that can be released via a strap or cable have pull axes that are perpendicular to the buckle. That makes it nearly impossible to conceal the strap or the release motion. Such concealment is much more feasible with the buckle of the present invention.

The invention claimed is:

1. A buckle assembly comprising a tongue and a buckle, the tongue having an end portion insertable into a mouth of the buckle to lockingly engage the buckle;

the buckle including a housing and two locking pawls in the housing that are pivotable between a locking position blocking removal of the tongue from the buckle and a release position enabling removal of the tongue from the buckle;

the buckle including a spring engaging the pawls that biases the pawls into the locking position;

the pawls having portions that are manually engageable to receive force to pivot the pawls from the locking position to the release position against the bias of the spring thereby to enable removal of the tongue from the buckle as a primary release mechanism; and the spring having a portion for receiving pulling force from a cable or lanyard to cause the spring to move the pawls from the locking position to the release position to enable removal of the tongue from the buckle as a secondary release mechanism;

wherein the spring is a torsion coil spring having a central coil portion for receiving the pulling force and having two end portions that engage the respective pawls.

2. A buckle assembly comprising a tongue and a buckle, the tongue having an end portion insertable into a mouth of the buckle to lockingly engage the buckle;

the buckle including a housing and two locking pawls in the housing that are pivotable between a locking position blocking removal of the tongue from the buckle and a release position enabling removal of the tongue from the buckle;

the buckle including a spring engaging the pawls that biases the pawls into the locking position;

the pawls having portions that are manually engageable to receive force to pivot the pawls from the locking position to the release position against the bias of the spring thereby to enable removal of the tongue from the buckle as a primary release mechanism; and the spring having a portion for receiving pulling force from a cable or lanyard to cause the spring to move the pawls from the locking position to the release position to enable removal of the tongue from the buckle as a secondary release mechanism;

wherein the housing has a window through which a portion of a cable or lanyard can extend for transmitting pulling force to the spring, and wherein the housing constrains the spring and the portion of the cable or lanyard to move substantially only in a direction parallel to the direction of movement of the tongue into and out of the buckle.

3. A buckle assembly comprising a tongue and a buckle, the tongue having an end portion insertable into a mouth of the buckle to lockingly engage the buckle;

the buckle including a housing and two locking pawls in the housing that are pivotable between a locking position blocking removal of the tongue from the buckle and a release position enabling removal of the tongue from the buckle;

the buckle including a spring engaging the pawls that biases the pawls into the locking position;

the pawls having portions that are manually engageable to receive force to pivot the pawls from the locking position to the release position against the bias of the spring thereby to enable removal of the tongue from the buckle as a primary release mechanism; and the spring having a portion for receiving pulling force from a cable or lanyard to cause the spring to move the pawls from the locking position to the release position to enable removal of the tongue from the buckle as a secondary release mechanism;

wherein the two pawls are separate pieces from each other when assembled in the buckle, and are made from metal and are substantially non-deformable; and the spring is a separate piece from the pawls when assembled in the buckle, and is made from metal and is resiliently deformable to control the positioning of the pawls.

4. A buckle as set forth in claim 3 wherein the spring biases the pawls into a locking position and the spring has a portion for receiving pulling force from a cable or lanyard to cause the spring to move the pawls from the locking position to a release position to enable removal of the tongue from the buckle as a secondary release mechanism.

5. A buckle as set forth in claim 4 wherein the primary release mechanism includes manually engageable portions of the pawls for receiving manual force for causing the pawls to move from the locking position to the release position to enable removal of the tongue from the buckle as a primary release mechanism.

6. A buckle as set forth in claim 5 wherein the housing has pawl support portions that support the pawls on the housing for pivotal movement about respective pivot axes between the locking position and the release position, the pawls having spring engagement portions that are on opposite sides of the pivot axes from the manually engageable portions of the pawls.

* * * * *